US011262706B2

(12) United States Patent
Riedo et al.

(10) Patent No.: US 11,262,706 B2
(45) Date of Patent: Mar. 1, 2022

(54) TOOL FOR ACTUATING A CORRECTOR FITTED IN A SMALL PORTABLE OBJECT SUCH AS A TIMEPIECE

(71) Applicant: Montres Breguet S.A., L'Abbaye (CH)

(72) Inventors: Christophe Riedo, Le Lieu (CH); Patrice Golay, Le Sentier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 573 days.

(21) Appl. No.: 16/136,500

(22) Filed: Sep. 20, 2018

(65) Prior Publication Data

US 2019/0137938 A1 May 9, 2019

(30) Foreign Application Priority Data

Nov. 9, 2017 (EP) ..... 17200902

(51) Int. Cl.

| | |
|---|---|
| ***G04D 1/02*** | (2006.01) |
| ***G04B 3/04*** | (2006.01) |
| ***G04G 17/02*** | (2006.01) |
| ***G04G 5/04*** | (2006.01) |
| ***G04B 3/02*** | (2006.01) |

(52) U.S. Cl.

CPC ..... *G04D 1/027* (2013.01); *G04B 3/02* (2013.01); *G04B 3/048* (2013.01); *G04G 5/04* (2013.01); *G04G 17/02* (2013.01)

(58) Field of Classification Search

CPC ..... G04D 1/027; G04B 3/02; G04B 3/048

See application file for complete search history.

(56) References Cited

U.S. PATENT DOCUMENTS

| | | | | |
|---|---|---|---|---|
| 3,782,102 | A | 1/1974 | Bergey | |
| 4,681,461 | A | 7/1987 | Gogniat | |
| 9,195,351 | B1 * | 11/2015 | Rosenberg | G06F 3/041 |
| 9,285,903 | B1 * | 3/2016 | Yun | G06F 3/04883 |
| 9,588,599 | B2 * | 3/2017 | Fullerton | G06F 3/046 |
| 2007/0171205 | A1 * | 7/2007 | Steinberg | G06F 3/0202 345/168 |
| 2007/0215442 | A1 | 9/2007 | Ozawa et al. | |
| 2009/0167727 | A1 | 7/2009 | Liu et al. | |
| 2014/0168175 | A1 * | 6/2014 | Mercea | G06F 3/046 345/179 |

FOREIGN PATENT DOCUMENTS

| | | | |
|---|---|---|---|
| EP | 0 224 030 | A1 | 6/1987 |
| EP | 1 835 364 | A1 | 9/2007 |
| EP | 2 077 488 | A1 | 7/2009 |
| FR | 2 134 533 | A1 | 12/1972 |
| JP | 2006-236952 | A | 9/2006 |

OTHER PUBLICATIONS

European Search Report dated May 24, 2018 in European Application 17200902.0 filed on Nov. 9, 2017 (with English Translation of Categories of Cited Documents).

* cited by examiner

*Primary Examiner* — Hadi Shakeri

(74) *Attorney, Agent, or Firm* — Oblon, McClelland, Maier & Neustadt, L.L.P.

(57) ABSTRACT

A tool for actuating a corrector push-button fitted in a small portable object, wherein this actuation tool includes a body which extends between a rear end which defines a gripping zone of the actuation tool and a front end which defines an actuation zone of the actuation tool, at least the front end of the actuation tool being magnetised.

9 Claims, 4 Drawing Sheets

N
S
1
2
6
8
24
28
30
32
32a
32b
34
36

1
2
6
8
26a
26b
28
30
32
32a
32b
34
36
38a
38b
N
S 1
6
8
2
40

1
6
40
N
S
8
2
28

32b
30
36
34
32
32a
N
S

TOOL FOR ACTUATING A CORRECTOR FITTED IN A SMALL PORTABLE OBJECT SUCH AS A TIMEPIECE

This application claims priority from European Patent Application No. 17200902.9 filed on Nov. 9, 2017, the entire disclosure of which is hereby incorporated herein by reference.

TECHNICAL FIELD OF THE INVENTION

The present invention relates to a tool for actuating a corrector fitted in a small portable object such as a timepiece. The invention relates more particularly to a tool for actuating a small push-button also known as a corrector routinely fitted in portable objects such as grand complication wristwatches or smart telephones.

TECHNOLOGICAL BACKGROUND OF THE INVENTION

Some watches, particularly so-called grand complication watches, offer the users thereof such a high number of functions that it is not possible to correct them all using a single winding and correction crown. For this reason, such watches comprise additional control means such as push-buttons. There exist push-buttons of different types among which are found miniature push-buttons which are typically embedded in the middle of the watch and which are usually actuated using a pointed instrument. These miniature push-buttons conventionally comprise a socket driven, glued or screwed into an opening created in the middle of the watch, and a cylindrical control rod suitable for sliding freely in the socket. The socket comprises, on the outside of the case, a first cylindrical passage adapted to the dimensions of a first portion of the control rod, and on the inside of the case, a second cylindrical passage arranged extending from the first cylindrical passage and wherein the internal diameter, adapted to the dimensions of a second portion of the control rod, is less than that of the first cylindrical passage. A packing seal housed in an undercut formed on a perimeter of the first portion of the control rod makes it possible to ensure the tightness between the control rod and the socket. Such a push-button also comprises a helical spring which is compressed when the user presses on the miniature push-button, and whose return force returns the control rod to the rest position when the user releases the pressure on the push-button.

Push-buttons of the type described above have very small dimensions. Such push-buttons therefore make it possible to save space. Furthermore, they do not protrude from the middle and therefore are not liable to be actuated involuntarily. Correction operations are carried out by pressing the control rod in the socket against the return force of the helical spring by means of a pointed instrument such as a pen for example. The latter point poses a problem. Indeed, as mentioned hereinbefore, such push-buttons are most frequently fitted in grand complication wristwatches. These are extremely expensive watches the cases thereof are very often produced using valuable materials. However, the risks of damaging the watch case and altering the aesthetic appearance thereof when handling a pointed instrument are high, which has become difficult to accept.

Obviously, the option remains of returning the watch to the workshop for it to be re-polished therein, but this is not very convenient.

Push-buttons of the type described above are also found on other small portable objects such as smart telephones and the actuation thereof frequently serves to reset the electronic circuits of the telephone.

SUMMARY OF THE INVENTION

An object of the present invention is to remedy the above-mentioned problems along with others by providing a tool suitable for use by horologists, but above all intended for those wearing watches and suitable for actuating small push-buttons also known as correctors without risking damage to the watch case middle. The tool according to the invention may also be used for actuating correctors fitted for example in smart telephones and which serve for example to reset the telephone operating system.

To this end, the present invention relates to a tool arranged to actuate a corrector push-button fitted in a small portable object, this actuation tool comprising a body which extends between a rear end which defines a gripping zone of the actuation tool and a front end which defines an actuation zone of the actuation tool, at least the front end of the actuation tool being magnetised, the portable object comprising a middle inside which the corrector push-button is arranged, at least one component of the corrector push-button or a zone of the middle immediately surrounding the corrector push-button being made of a magnetic material such as a ferromagnetic material, such that, when the actuation tool is moved towards the portable object, the actuation tool will come spontaneously into contact with the corrector push-button under the effect of the magnetic attraction force exerted thereon by the corrector push-button or the at least one zone of the middle.

According to one embodiment of the invention, a bar magnet is arranged in the front end of the actuation tool.

According to a further embodiment, the body of the actuation tool is produced using a magnetic material.

The invention also relates to a small portable object such as a timepiece, this portable object comprising a middle in an opening of which is arranged a corrector push-button, at least one element of the corrector push-button or at least one zone of the middle immediately surrounding the corrector push-button being made of a magnetic material such as a ferromagnetic material, this corrector push-button being arranged to be actuated by means of an actuation tool comprising a body which extends between a rear end which defines a gripping zone of the actuation tool and a front end which defines an actuation zone of the actuation tool, at least the front end of the actuation tool being magnetised, such that, when the actuation tool is moved towards the portable object, the actuation tool will come spontaneously into contact with the corrector push-button under the effect of the magnetic attraction force exerted thereon by the corrector push-button or the at least one zone of the middle.

The invention also relates to an assembly comprising an actuation tool of a corrector push-button fitted in a small portable object, this actuation tool comprising a body which extends between a rear end which defines a gripping zone of the actuation tool and a front end which defines an actuation zone of the actuation tool, at least the front end of the actuation tool being magnetised, the portable object comprising a middle in an opening of which is fixed a push-button type corrector, at least one element of the corrector or at least one zone of the middle of the portable object immediately surrounding the corrector being made of a magnetic material such as a ferromagnetic material, a first magnetic polarity thereof being opposed to a second magnetic polarity of the magnetised actuation tool.

The invention also relates to an assembly comprising a tool for actuating a push-button type corrector fitted in a small portable object, this actuation tool comprising a body which extends between a rear end which defines a gripping zone of the actuation tool and a front end which defines an actuation zone of the actuation tool, at least the front end of the actuation tool being made of a ferromagnetic material, the portable object comprising a middle in an opening of which is fixed a push-button type corrector, at least one element of the corrector or at least one zone of the middle immediately surrounding the corrector being made of a magnetic material.

As a result of these features, the present invention provides an actuation tool which, under the effect of the magnetic attraction force exerted thereon by the corrector or the close environment of the corrector, will come spontaneously into contact with the corrector, at the centre thereof, such that the user merely needs to push on the actuation tool to be able to actuate the corrector. The risks of the actuation tool slipping on the middle of the portable object equipped with the corrector and scratching said middle when the user wishes to actuate the corrector are low, or even non-existent.

As will be understood from the above, various combinations between the actuation tool and the portable object may be envisaged:

- the actuation tool has a magnetic polarity and the corrector or the close environment thereof has a magnetic polarity in the opposite direction to that of the polarity of the actuation tool;
- the actuation tool has a magnetic polarity and the corrector or the close environment thereof is made of a ferromagnetic material;
- the actuation tool is made of a ferromagnetic material and the corrector or the close environment thereof has a magnetic polarity.

BRIEF DESCRIPTION OF THE FIGURES

Further features and advantages of the present invention will emerge more clearly from the following detailed description of two different examples of embodiments of an actuation tool according to the invention, this example being given merely by way of illustration and not limitation in connection with the appended drawing wherein.

DETAILED DESCRIPTION OF AN EMBODIMENT OF THE INVENTION

The present invention proceeds from the general inventive idea which consists of providing an actuation tool suitable for actuating a corrector type push-button embedded in the middle of a portable object such as a complication wristwatch or a smart telephone without any risk of damaging the middle of the portable object which, particularly in the case of wristwatches, is very often made of a valuable material. To achieve this aim, the present invention discloses using an actuation tool which, by magnetic attraction exerted by the corrector or a portion of the middle close to the corrector, guides the point of the tool to the centre of the corrector. Once the actuation tool has been centred on the corrector, the user merely needs to push on the corrector to enter a command. Any risk of seeing the end of the actuation tool slip on the middle and damage same is thereby removed.

Figure 1:
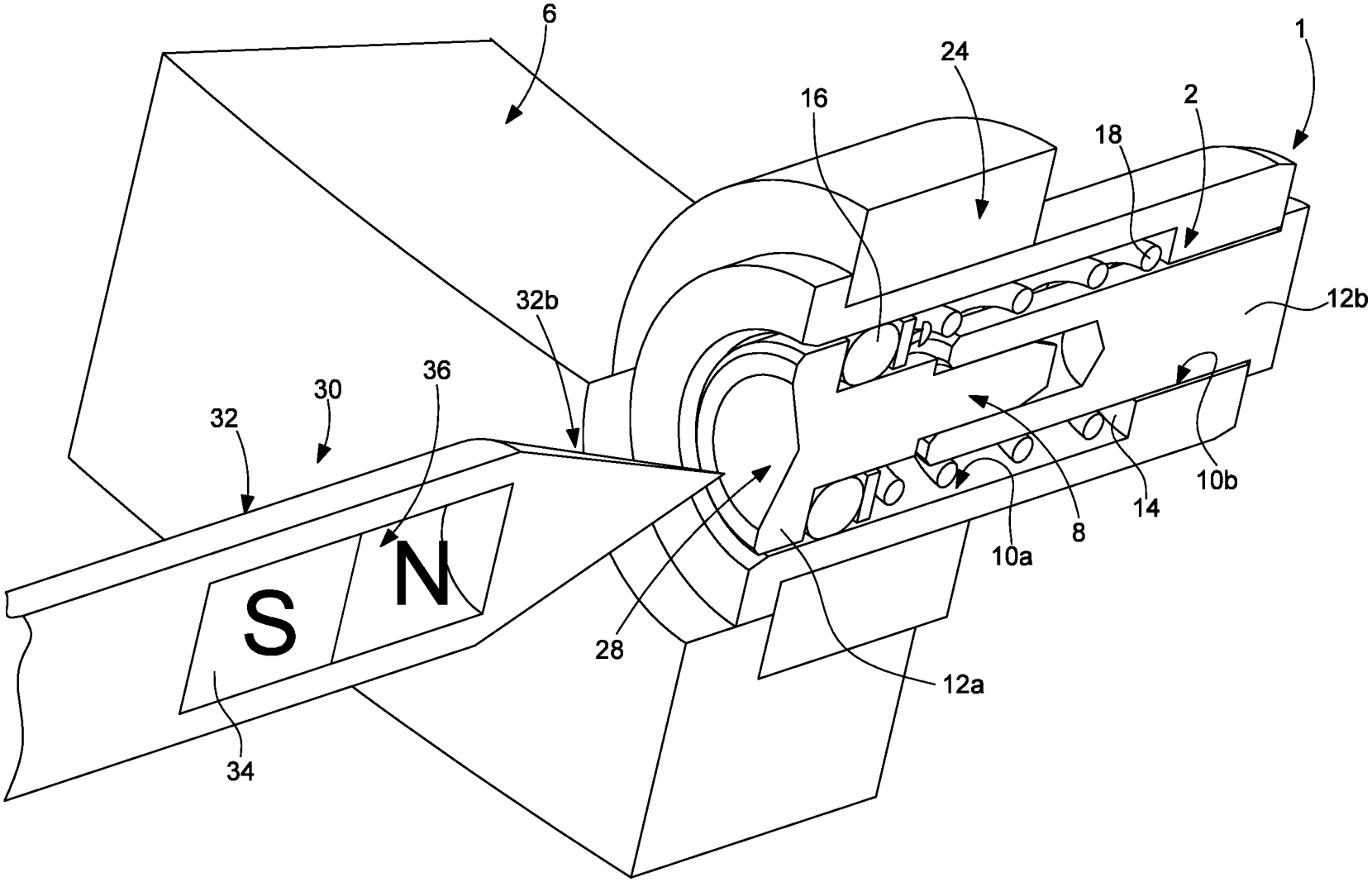
FIG. 1 is a perspective view of an embodiment of a corrector push-button whose actuation is carried out by means of an actuation tool according to the invention.

FIG. 1 is a perspective view of an embodiment of a corrector type push-button whose actuation may be carried out by means of an actuation tool according to the invention. It will be understood however that the description of such a corrector push-button is given merely by way of illustration and is in no way limiting. As will be seen hereinafter, it consists of a conventional type corrector push-button the structure thereof only needs at most to be modified in respect of the choice of the material with which the components thereof are produced, while in some embodiments of the invention, the structure of the corrector push-button remains unchanged.

Denoted as a whole by the general reference number 1, a corrector type push-button conventionally comprises a socket 2 for example driven or glued in an opening 4 formed in a middle 6 of a portable object, for example a wristwatch whose middle is made of a valuable material or indeed a smart telephone.

A cylindrical control rod 8 is suitable for sliding in the socket 2. The socket 2 comprises for this purpose a first cylindrical passage 10*a* which opens on the outside of the middle 6 of the portable object and which is adapted to the dimensions of a first portion 12*a* of the control rod 8. On the inside of the middle 6, the socket 2 comprises a second cylinder passage 10*b* arranged extending from the first cylindrical passage 10*a* and which defines a shoulder 14 inside the socket 2. The internal diameter of this second cylindrical passage 10*b*, adapted to the dimensions of a second portion 12*b* of the control rod 8, is less than that of the first cylindrical passage 10*a*. A packing seal 16 housed in an undercut formed on a perimeter of the first portion 12*a* of the control rod 8 makes it possible to ensure the tightness between the control rod 8 and the socket 2. Such a corrector push-button 1 also comprises a helical spring 18 which is compressed when the user presses on the corrector push-button 1, and whose return force returns the control rod 8 to the rest position when the user releases the pressure on the corrector push-button 1. The helical spring 18 presses against a washer 20 fixedly mounted on the first portion 12*a* of the control rod 8 at one end, and against the shoulder 14 at the other end.

Push-buttons of the type described above have very small dimensions. Such push-buttons therefore make it possible to save space. Furthermore, they do not protrude from the middle and therefore are not liable to be actuated involuntarily. Such push-buttons are frequently fitted in top-of-the-range watches known as complication watches. Correction operations are carried out by means of a pointed instrument such as a pen for example. The latter point poses a problem, however. Indeed, grand complication wristwatches are expensive watches the cases thereof being very often produced using valuable materials. However, the risks of damaging the watch case and altering the aesthetic appearance thereof when handling a pointed instrument are high, which has become difficult to accept.

Figures 2A, 2B, 2C, 3A, 3B, 3C:
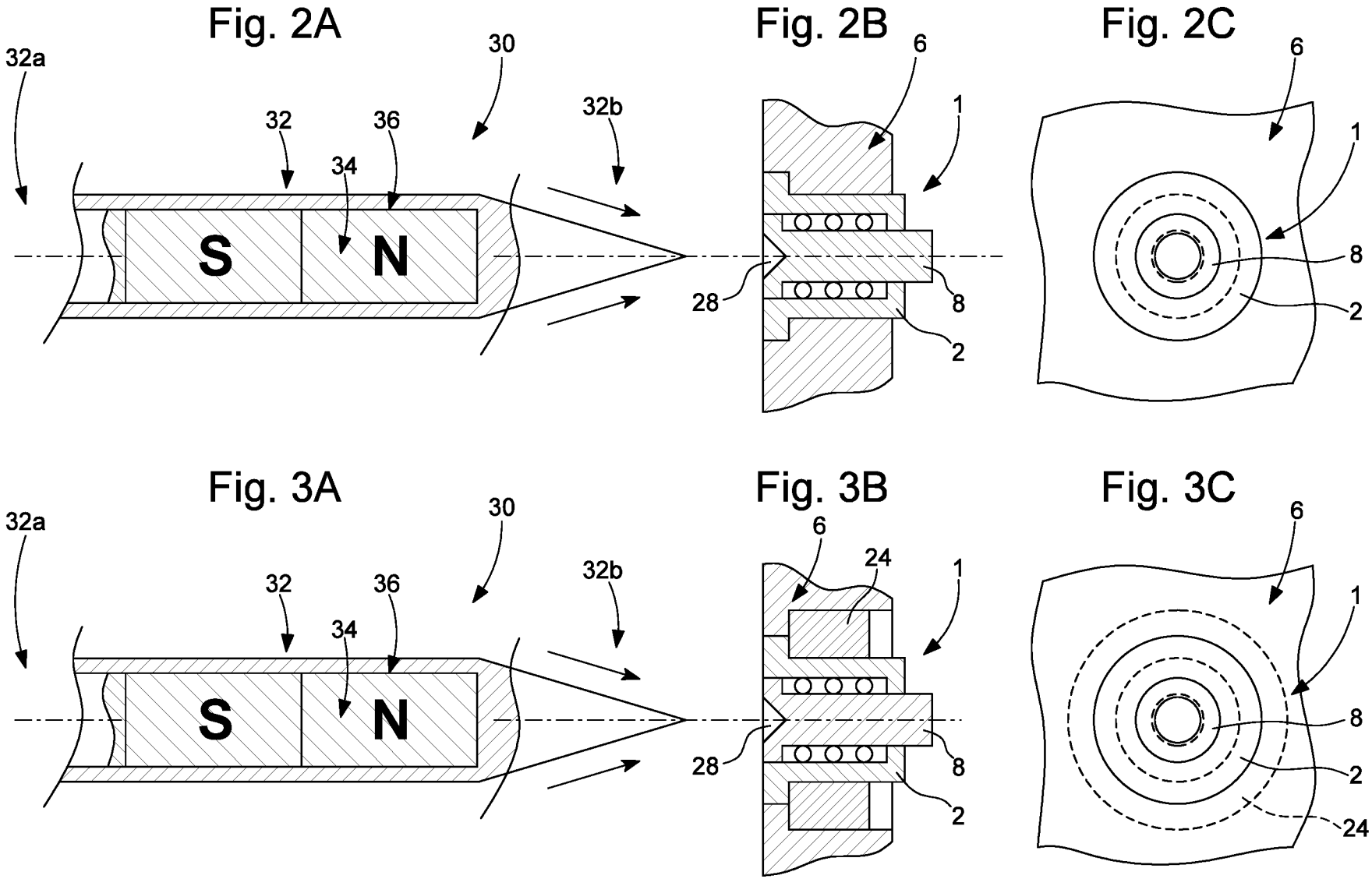
FIG. 2A is a longitudinal sectional view of the actuation tool according to the invention equipped with a magnet.
FIGS. 2B and 2C are respectively longitudinal and elevation sectional views of the corrector push-button according to the invention which comprises at least one component made of a ferromagnetic material and which is suitable for the actuation tool in FIG. 2A.
FIG. 3A is a longitudinal sectional view of the actuation tool according to the invention equipped with a magnet.
FIGS. 3B and 3C are respectively longitudinal and elevation sectional views of the corrector push-button according to the invention with which is associated a ferromagnetic ring and which is suitable for the actuation tool in FIG. 3A.

To remedy this problem, the present invention discloses that at least one of the components of the corrector push-button 1 detailed above is made using a ferromagnetic material, i.e. a material which is magnetisable (see FIGS. 2B and 2C). This may consist, merely by way of illustration and not limitation, of the socket 2, or indeed the control rod 8, or indeed these two components simultaneously. In the case where, for example, the control rod 8 is made of a ferromagnetic material, the middle 6 of the portable object will be preferentially made of a non-magnetisable material.

It may nonetheless be envisaged that at least one portion 22 of the middle 6 of the portable object situated in the immediate vicinity of the corrector push-button 1 is also made of a ferromagnetic material.

Preferably, this portion 22 of the middle 6 will be arranged with a circular symmetry around the corrector push-button 1. It may consist, for example, of a ring 24 arranged concentrically around the socket 2 (see FIGS. 3B and 3C). It may also consist, for example, of two studs 26*a* and 26*b* made of a ferromagnetic material and preferentially arranged in a diametrically opposed manner relative to the centre 28 of the corrector push-button 1 represented by the control rod 8 (see FIGS. 4B and 4C). Similarly, it may be envisaged that none of the components of the corrector push-button 1 be made of a ferromagnetic material, only a portion 22 of the middle 6 then being made of such a ferromagnetic material.

The term "immediate vicinity" denotes that the portion 22 of the middle 6 is arranged sufficiently close to the corrector push-button 1 such that, when the user moves the actuation tool 30 according to the invention closer to the corrector push-button 1, the magnetic attraction exerted on this actuation tool 30 guides this tool 30 towards the control rod 8, i.e. towards the centre 28 of the corrector push-button 1. The user then merely needs to push on the actuation tool 30 to be able to actuate the corrector push-button 1.

More specifically, in respect of the actuation tool 30 according to the invention, said tool comprises a body 32 which extends between a rear end 32*a* which defines a gripping zone of this actuation tool 30, and a front end 32*b* which defines an actuation zone of this tool 30. According to one embodiment of the invention, the actuation tool 30 is entirely made of a magnetic material and is attracted by the ferromagnetic material with which at least a portion 22 of the middle and/or at least one of the components of the corrector push-button 1 is made. As such, when the actuation tool 30 is moved towards the portable object, this actuation tool 30 is irresistibly attracted by the corrector push-button 1, towards the centre 28 thereof. According to a further embodiment of the invention illustrated in FIGS. 2A, 3A, 4A and 6A, a bar magnet 34 is arranged in a housing 36 provided in the front end 32*b* of the body 32 which defines the actuation zone of the actuation tool 30.

The embodiment described above is particularly advantageous because, as it only involves a bar magnet 34 at the actuation tool 30 side, and the middle 6 and/or corrector push-button 1 merely comprise a ferromagnetic material, there is no need to concern oneself with the polarity of the magnet to ensure the magnetic attraction of the actuation tool 30 by the portable object.

Figures 4A, 4B, 4C, 5A, 5B, 5C:
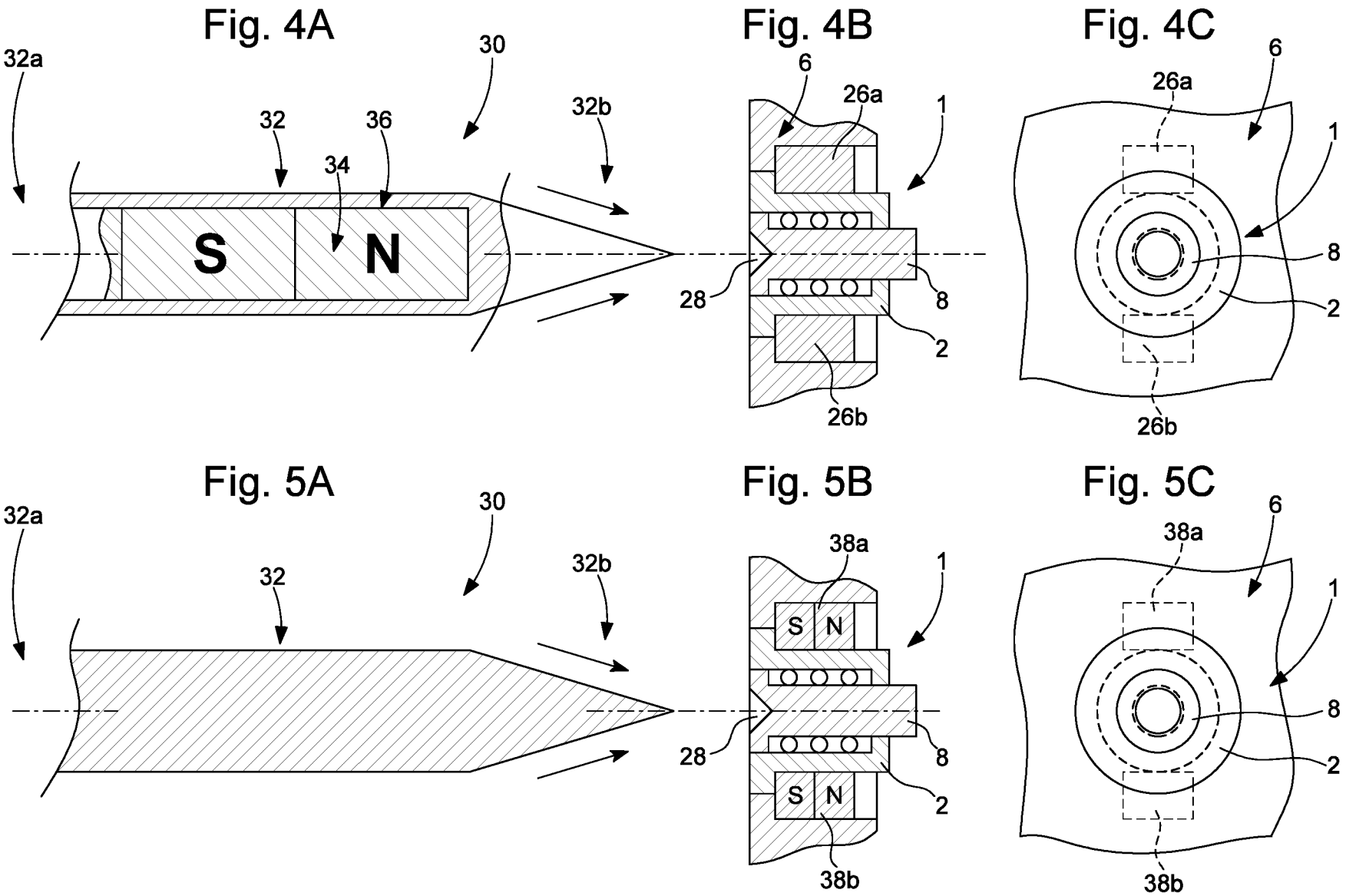
FIG. 4A is a longitudinal sectional view of the actuation tool according to the invention equipped with a magnet.
FIGS. 4B and 4C are respectively longitudinal and elevation sectional views of the corrector push-button according to the invention with which are associated two ferromagnetic studs and which is suitable for the actuation tool in FIG. 4A.
FIG. 5A is a longitudinal sectional view of the actuation tool according to the invention made of a ferromagnetic material.
FIGS. 5B and 5C are respectively longitudinal and elevation sectional views of the corrector push-button according to the invention with which are associated two discrete bipolar magnets and which is suitable for the actuation tool in FIG. 5A.

A further embodiment of the invention consists of producing all or part of the actuation tool in a ferromagnetic material and arranging a bipolar magnet in the portable object. It is thereby possible to envisage (see FIG. 5A) that the front end 32*b* which defines the actuation zone of the actuation tool 30 be made of a ferromagnetic material, and that at least one component of the corrector push-button 1, for example the control rod 8 or the socket 2, be made of a magnetic material. It may also be envisaged to arrange at least one and, preferably, two discrete bipolar magnets 38*a* and 38*b* preferentially in a diametrically opposed manner relative to the centre 28 of the corrector push-button 1. Similarly, the discrete bipolar magnets 38*a*, 38*b* may be replaced by an annular magnet 40 arranged around the socket 2 of the corrector push-button 1, at a short distance therefrom (FIGS. 5B and 5C).

In this case likewise, a bipolar magnet 38, 40 is only involved on the portable object side, such that it is not necessary to concern oneself with the polarity of the magnet to ensure the magnetic attraction of the actuation tool 30 by the portable object.

Figures 6A, 6B, 6C:
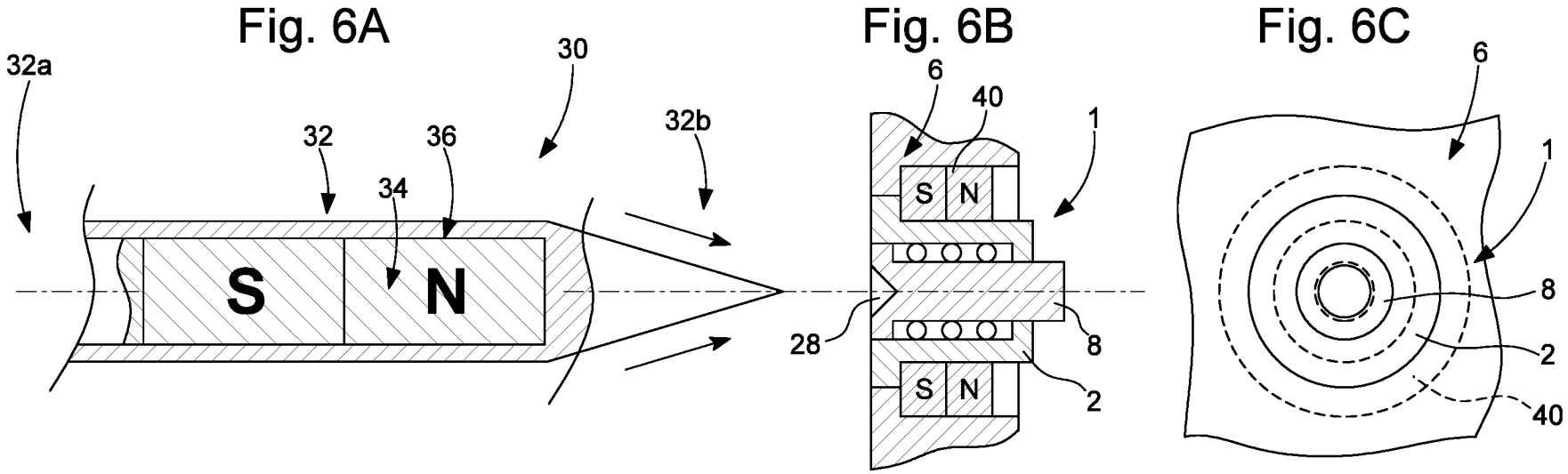
FIG. 6A is a longitudinal sectional view of the actuation tool according to the invention equipped with a magnet.
FIGS. 6B and 6C are respectively longitudinal and elevation sectional views of the corrector push-button according to the invention with which is associated an annular magnet and which is suitable for the actuation tool in FIG. 6A.

According to a further embodiment of the invention, a bipolar magnet 42 is arranged in the front end 32*b* of the actuation zone of the actuation tool 30 (FIG. 6A), and at least one component of the corrector push-button 1 and/or at least one portion 22 of the middle 6 is made of a magnetic material (FIGS. 6B and 6C). It will be understood that, in this embodiment, it is necessary to ensure that the magnetic polarity of the actuation tool opposes the magnetic polarity of the corrector push-button 1.

It is obvious that the present invention is not restricted to the embodiments described above, and that various modifications and simple alternative embodiments may be envisaged by those skilled in the art without leaving the scope of the invention as defined by the appended claims.

REFERENCE LIST

1. Corrector push-button
2. Socket
4. Opening
6. Middle
8. Control rod
10*a*. First cylindrical passage
10*b*. Second cylindrical passage
12*a*. First portion
12*b*. Second portion
14. Shoulder
16. Packing seal
18. Helical spring
20. Washer
22. Portion

24. Ring
26*a*, 26*b*. Studs
28. Centre
30. Actuation tool
32. Body
32*a*. Rear end
32*b*. Front end
34. Bar magnet
36. Housing
38*a*, 38*b*. Discrete bipolar magnets
40. Annular magnet
42. Bipolar magnet

What is claimed is:

1. An assembly comprising:

a watch including a corrector push-button; and an actuation tool for actuating the corrector push-button fitted in the watch, wherein the actuation tool comprises a body which extends between a rear end which defines a gripping zone of the actuation tool and a front end which defines an actuation zone of the actuation tool, wherein at least the front end of the actuation tool is made of a ferromagnetic material, wherein the watch comprises a middle in an opening whereof is arranged a corrector push-button, the corrector push-button including a socket, a control rod that is movable within the socket, and a spring that is compressed when the control rod is pressed into the socket, wherein at least one component of the corrector push-button or at least one portion of the middle immediately surrounding the corrector push-button is made of a magnetised material.

2. The assembly according to claim 1, wherein the control rod is made of the magnetised material and the at least one portion of the middle is made of non-magnetisable material.

3. The assembly according to claim 1, wherein the control rod is made of non-magnetisable material and the at least one portion of the middle is made of the magnetised material.

4. The assembly according to claim 3, wherein the at least one portion of the middle is made of the magnetised material includes a ring arranged concentrically around the socket.

5. The assembly according to claim 3, wherein the at least one portion of the middle is made of the magnetised material includes two studs arranged in a diametrically opposed manner relative to a center of the corrector push-button.

6. The assembly according to claim 3, wherein the at least one portion of the middle is made of the magnetised material includes two discrete bipolar magnets arranged in a diametrically opposed manner relative to a center of the corrector push-button.

7. The assembly according to claim 3, wherein the at least one portion of the middle is made of the magnetised material includes an annular magnet arranged around the socket.

8. The assembly according to claim 3, wherein the actuation tool comprises a bar magnet arranged in the front end thereof.

9. The assembly according to claim 3, wherein the body of the actuation tool is made of a magnetic material.

* * * * *